US006588412B2

(12) United States Patent
Ferrara et al.

(10) Patent No.: US 6,588,412 B2
(45) Date of Patent: Jul. 8, 2003

(54) HOPPER ADAPTOR FOR A PAINT BALL GUN

(76) Inventors: William J. Ferrara, 1469 MW 129 Way, Sunrise, FL (US) 33323; Brian P. Saponaro, 390 SW. 121 Ave., Plantation, FL (US) 33325

( * ) Notice: Subject to any disclaimer, the term of this patent is extended or adjusted under 35 U.S.C. 154(b) by 0 days.

(21) Appl. No.: 09/993,838

(22) Filed: Nov. 16, 2001

(65) Prior Publication Data

US 2002/0059928 A1 May 23, 2002

Related U.S. Application Data

(60) Provisional application No. 60/249,525, filed on Nov. 17, 2000.

(51) Int. Cl.[7] ..... F41B 11/02
(52) U.S. Cl. ..... 124/49; 285/354
(58) Field of Search ..... 124/45, 49, 50, 124/73, 74; 285/322, 323, 353, 354, 384, 385, 389, 421

(56) References Cited

U.S. PATENT DOCUMENTS

| | | | | | |
|---|---|---|---|---|---|
| 2,174,105 | A | * | 9/1939 | Haury | |
| 2,862,732 | A | * | 12/1958 | Guillou | |
| 3,219,367 | A | * | 11/1965 | Franck | |
| 5,282,454 | A | * | 2/1994 | Bell et al. | 124/49 |
| 5,947,100 | A | * | 9/1999 | Anderson | 124/45 |

* cited by examiner

*Primary Examiner*—John A. Ricci
(74) *Attorney, Agent, or Firm*—Richard H. Saccocio

(57) ABSTRACT

An adaptor is provided between a hopper of a paint ball gun and the gun itself so as to effectuate a stable and secure but removable connection that does not deteriorate with successive disconnections and reconnections A compressible bushing is acted upon by a nut so as to radially compress the bushing and form a tight fit against a tube extending from the hopper. The nut is threaded onto a tube that is threadingly connected to the gun.

5 Claims, 4 Drawing Sheets

HOPPER ADAPTOR FOR A PAINT BALL GUN

CROSS REFERENCE TO RELATED APPLICATIONS

This application claims the benefit of U.S. Provisional Application No. 60/249,525, filed Nov. 17, 2000.

BACKGROUND OF THE INVENTION a. Field of the Invention

This invention relates, in general, to the field of paint ball guns and in particular to adaptor apparatus for securely mounting a paint ball hopper to a paint ball gun, which apparatus provides for rapid attachment and removal while providing for positive attachment.

b. Description of the Prior Art

A paint ball gun, in general, comprises three main components: a gun portion, a propellant portion and a hopper. The hopper contains a plurality of encapsulated paint balls, which, in general, are fed by gravity or gravity plus an assisting mechanism into the gun portion. The propellant portion provides the means to propel the paint ball out of the gun. The propellant portion and the gun portion are securely attached to each other, while the hopper is initially securely attached to the gun at a location above the gun portion. The hopper is fitted and attached to the paint ball gun by use of a prior art tube extending from the hopper, which is "press fitted" into a cylindrical opening in the gun, or is press fitted in a tube, which is threaded into the gun. In operation, a number of paint balls are loaded into the hopper through an opening at the top of the hopper, the paint balls are fed from the hopper into the gun and then discharged out of the nozzle by compressed gas. The ability to remove and reconnect a hopper is routine for a number of reasons, including but not limited to cleaning a hopper, trouble shooting the passage of paint balls from the hopper into the gun, for storage, for preventative maintenance procedures and other like operations.

The prior art press fit of the hopper to the gun thereby allows convenient removal and replacement a hopper; but, because the hopper is frequently removed from the gun and reattached, the initial tight fit becomes looser and looser, to an extent that the hopper will not stay in position on the gun. Typically, a person attempting to remove a hopper will employ a combination of twisting and side-to-side pulling motions until the hopper comes off. Understandably, such twisting and side to side pulling eventually causes the press fit to become a loose fit such that the hopper can become disengaged from the gun when no disengagement is desired. Moreover, such unintentional disengagement of the hopper from the gun can occur at the most inopportune times. For example, when an person is running which causes the gun to jump up and down, or when a person "hits the dirt" in going from a run to lying prone on the ground to either fire the paint ball gun or to take cover. When the hopper inadvertently becomes disengaged from the gun, the gun is inoperable which is not at all satisfactory. Further, when the press fit becomes too loose, a new hopper may be required which adds an unnecessary expense and inconvenience to persons participating in the sport associated with paint ball guns.

What is needed then, is attachment apparatus between the hopper and the gun that forms a tight connection, which does not loosen as a result of removing or replacing hoppers, forms an effective seal, and provides for rapid attachment and disengagement of the hopper when the gun is being used in the field or elsewhere and without tools.

The present invention simply and effectively provides the solution to these prior art problems.

SUMMARY OF THE INVENTION

The above objects as well as others are accomplished by the present invention which comprises adaptor apparatus that fits between a hopper of a paint ball gun and the gun itself. In one preferred embodiment, the adaptor apparatus is attached at one end, to either the hopper or the gun, while the other end is compression fitted to the other of the gun or the hopper. In accordance therewith, one end of the adaptor is threadingly connected to the gun and the other end utilizes a compressing device in association with a radially compressible bushing that is compressed onto a tube extending from a bottom of the hopper. The compression connection provides for the quick connect and removal of the hopper without the need for tools.

In accordance with the above, there has been summarized some of the more important features of one embodiment of the present invention in order that the detailed description of the invention as it appears in the below detailed description of the same, may be better understood.

BRIEF DESCRIPTION OF THE DRAWINGS

Various other objects, advantages, and features of the invention will become apparent to those skilled in the art from the following discussion taken in conjunction with the following drawings, in which.

DESCRIPTION OF THE PREFERRED EMBODIMENTS

Figure 1:
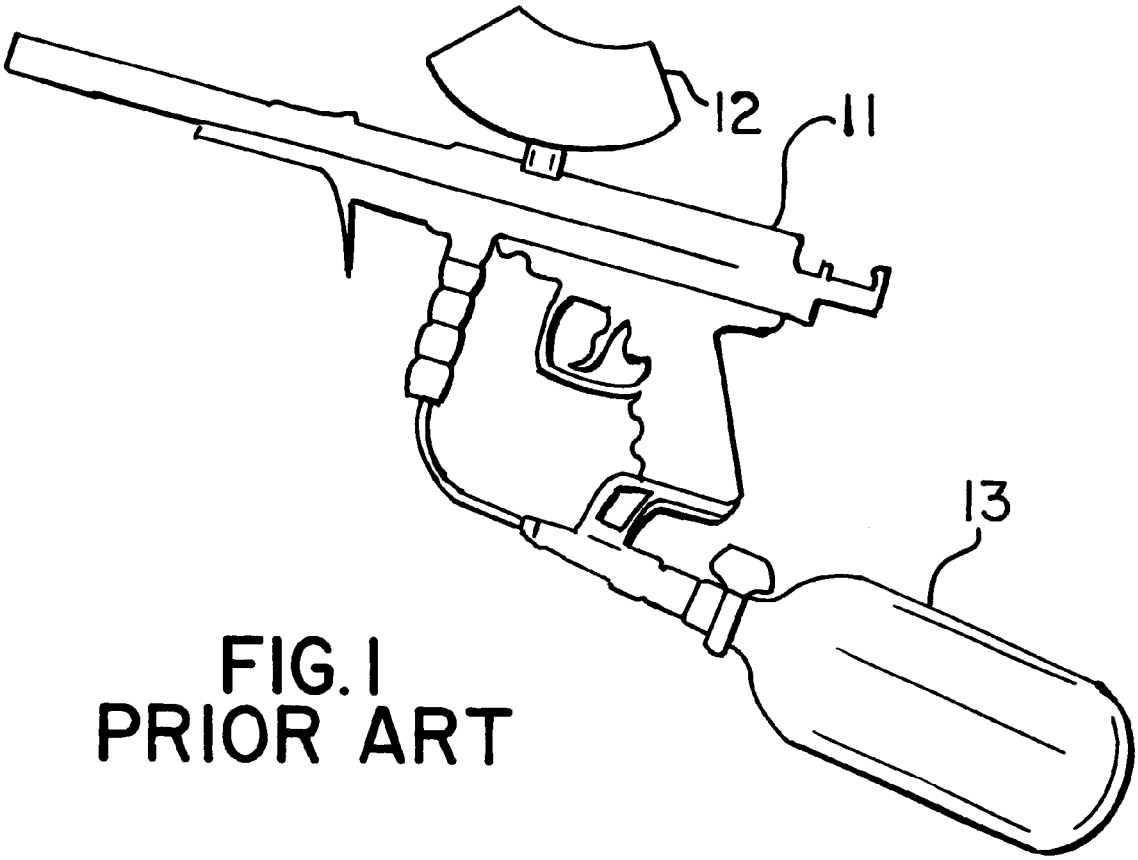
FIG. 1 PRIOR ART
FIG. 1 is a schematic representation of a typical prior art paint ball gun to which the adaptor of the present invention may be applied.

As required, detailed embodiments of the present invention are disclosed herein; however, it is to be understood that the disclosed embodiments are merely exemplary of the invention which may be embodied in various forms. Therefore, specific structural and functioning details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like the characteristics and features of the present invention shown in the various figures are designated by the same reference numerals.

Referring now to FIG. 1, a typical paint ball gun includes a gun portion 11, a hopper portion 12 and a propellant portion 13. As noted above, the propellant portion and the gun portion are securely connected together and are occasionally intended to be disengaged from each other such as when the propellant tank needs to be replaced. The hopper portion 12, on the other hand, is intended to be securely attached to the paint ball gun, but somewhat readily disengaged from the gun on a routine basis for sundry reasons such as cleaning, performing maintenance, trouble shooting the feeding of paint balls from the hopper into the gun, etc. In operation, paint balls are loaded into the hopper 12 and then individually funneled into the gun 11. Pulling the trigger causes the propellant to expel a single paint ball from the gun in the direction in which the gun is aimed. As the supply of paint balls in the hopper diminishes, the hopper is or can be refilled with additional paint balls.

The connection of the hopper to the gun, in the prior art comprises a male-female arrangement where a tube at the end of the hopper extends downward and is press fitted into an opening in the top of the gun, or the end of the hopper is press fitted into a tube that is threadingly attached to the gun. The tube is relatively large, for example three quarters of an inch or more, such that a standard paint ball can pass through the tube and into the gun. The tube thereby comprises a passage through which the paint balls contained within the hopper are transferred or fed into the gun. This type of connection, as explained above, initially provides for a sufficiently tight connection, which is needed to support the G-forces caused by the weight of a loaded hopper when the gun is rapidly moved from one position to another, such as when the person using the gun is running or falling down, but after a number of disengagements, the press fit becomes loose and the hopper can readily fall off the gun.

Figure 2:
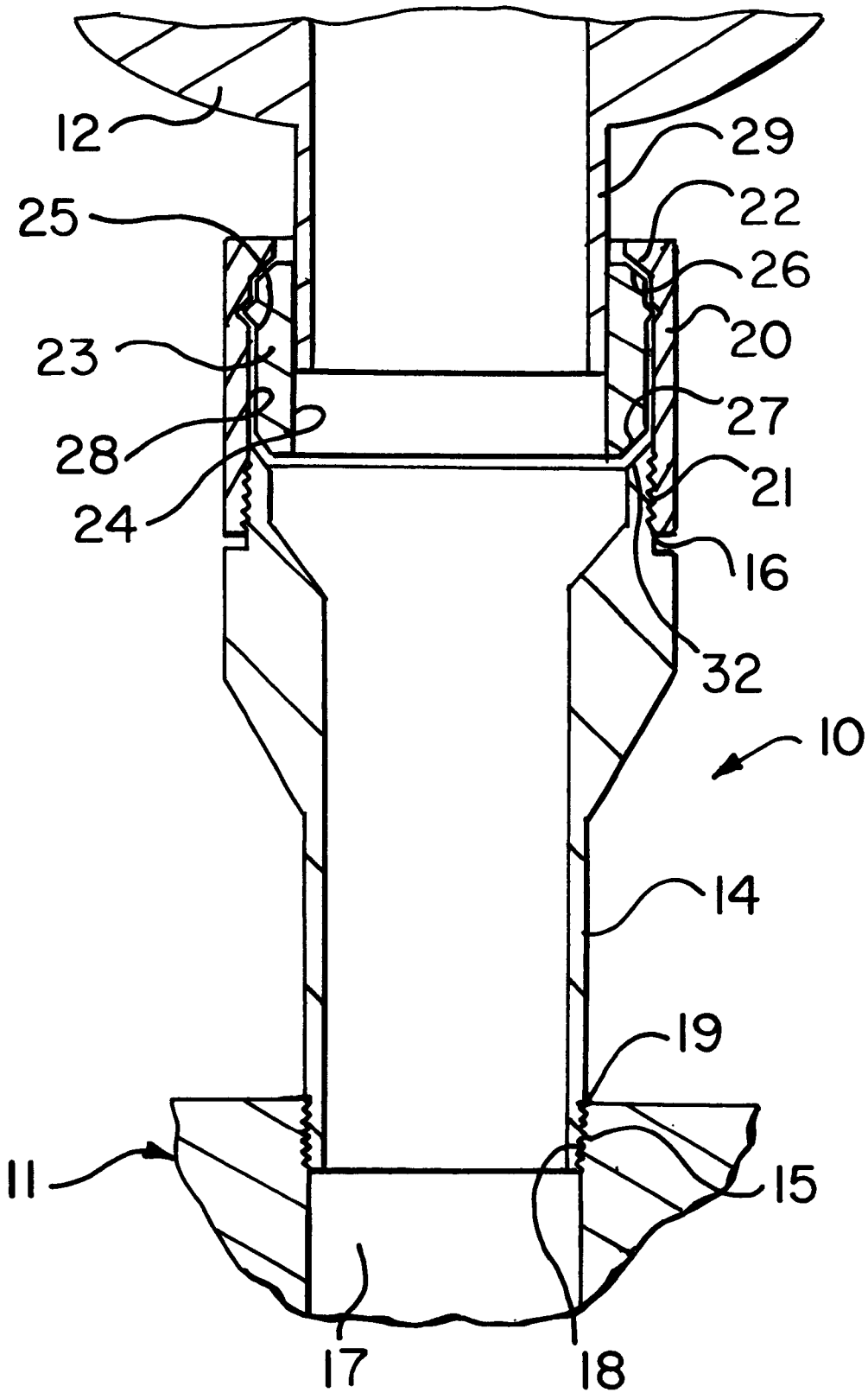
FIG. 2 illustrates a partial portion of the paint ball gun of FIG. 1 to which the inventive adaptor has been applied.

FIG. 2 shows, in cross section, the details of one embodiment of the inventive connecting adaptor 10 as it is positioned between the outlet tube 29 of a hopper 12 and the inlet opening 17 to the gun 11. In this embodiment, the inventive adaptor includes a tubular member 14, a bushing member 23 (which may also be referred to as a compression member), and a nut 20. The lower end of the tubular member 14 is threadingly attached 15 to the inlet opening 17 of gun 11, or is press fitted into opening 17. Although not necessary to the invention, a ledge 19 at the lower end of tubular member 14 seats against a corresponding surface on the gun 11 at the entrance of opening 17 to provide a firm and stable platform when tubular member 14 is fully threaded or press fitted into opening 18.

A type of a variable force, slip-fit connection connects the upper end of the tubular member 14 to the outlet tube 29 of the hopper 12. The bushing 23, which is compressible in an inwardly, radial direction, is positioned within a nut 20 and above the upper end of tube member 14 and in axial alignment therewith. For convenience of assembly and disassembly, the bushing can be non-permanently attached to the nut by means of a small lip extending from the bushing that mates with a groove in the inside of the nut. The nut 20 fitting over bushing 23 includes a flange 22 positioned at the upper edge of bushing 23. The upper end of tube 14 and the lower end of nut 20 are threadingly connected 21 such that tightening of the nut 20 causes flange 22 to bear down on bushing 23, while the upper end of tube member 19 bears up against the bushing 23, resulting in radial compression of bushing 23. As the tightening force of nut 20 increases, the bushing 23 continues to decrease in diameter until such time as it fits tightly up against the outer circumference of the hopper outlet tube 29. In this manner, one end of the inventive adaptor 10 is fly and securely attached to the hopper 12 and the other end of the inventive adaptor is firmly and securely attached to the gun 11.

In order to disengage the hopper 12 from the gun 11 all that is required is to loosen nut 20 which allows bushing 23 to return to its original uncompressed size thereby releasing the force against the outer circumference of hopper tube 29 which allows the hopper 12 to be pulled out of the top end of the adaptor 10 with relative ease and without the need to forcefully pull and twist the hopper. The attachment of the lower end of the adaptor 10 to the gun 11 is not disturbed during the disengagement procedure and therefore, neither a threaded connection or a press fit connection will become loose.

Figure 3:
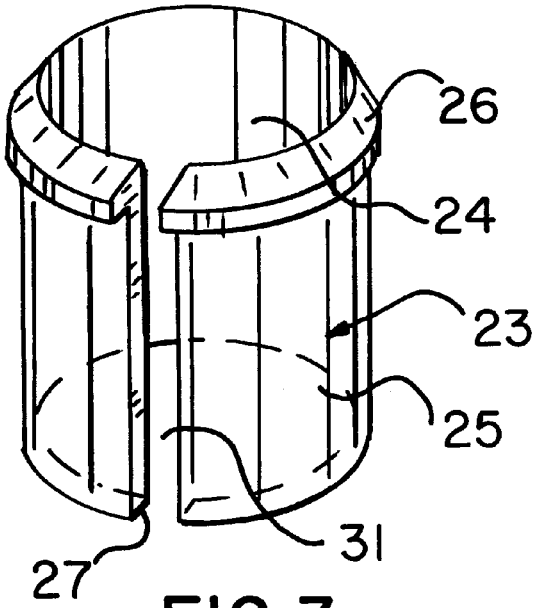
FIG. 3 illustrates one embodiment of the compressible bushing of FIG. 2.

In FIG. 3, it is seen that bushing 23 comprises a cylindrical member having an inner surface 24, an outer surface 25, a top surface or edge 26, a bottom surface or edge 27. A single opening 31 through the wall of the bushing extending from the upper edge 26 to the lower edge 27 is provided to allow the bushing to compress in diameter. The outer surface 25 of bushing 23 is dimensioned to have a diameter slightly less than the diameter of the inner surface 28 of nut 20. The length of compression member 23 is dimensioned to fit within the axial space formed between the flange 22 and the upper end 32 of tubular member 14 when nut 20 is partially threaded onto tubular member 14. A different version of the non-permanent attachment of the bushing to the nut is shown in FIG. 3 and comprises the protruding lip extending from the upper end of the bushing and a corresponding groove (not shown) in the nut.

The lower end surface 27 of bushing member 23 is tapered and fits against the upper end 32 of tube member 14 which end 32 is also tapered. The upper end surface 26 of compression member 23 and the inner surface of flange 22 are also tapered. The diameter of the inner surface 24 of bushing 23 is sized to be slightly greater than the outer diameter of the tube portion 29 extending downward from hopper 12. For convenience during engagement and disengagement of the hopper, the bushing is held in place within nut 20 by means of an annular ledge around the bushing and a small annular groove in the inside of nut 20.

When a hopper 12 is to be attached to a gun 11, nut 20 is tightened such that the flange 22 of nut 20 and the upper edge 32 of cylindrical member 14 begin to contact the upper and lower ends 26 and 27 of compression member 23, respectively. The lower end of hopper tube 29 is then inserted into the bushing 22 for an appropriate distance. The uncompressed size of bushing 22, as described above, allows for easy insertion of the hopper tube 29 into the bushing 22. When tightening of nut 20 continues, compression member 23 compresses inwardly, first taking up the small space between the inner diameter of the bushing 23 and the outer diameter of the hopper tube 29, and then applies a compressive force to the outer diameter of the tube 29 which results in a firm and secure connection of the hopper 12 to the gun 11. To remove a hopper 12 from a gun 11, it is a simple matter to loosen nut 20 which allows bushing 21 to expand to its original size recreating the clearance space between the bushing 23 and the hopper tube 29, thereby allowing the hopper tube 29, and the hopper 12 attached thereto, to be removed.

Figure 4:
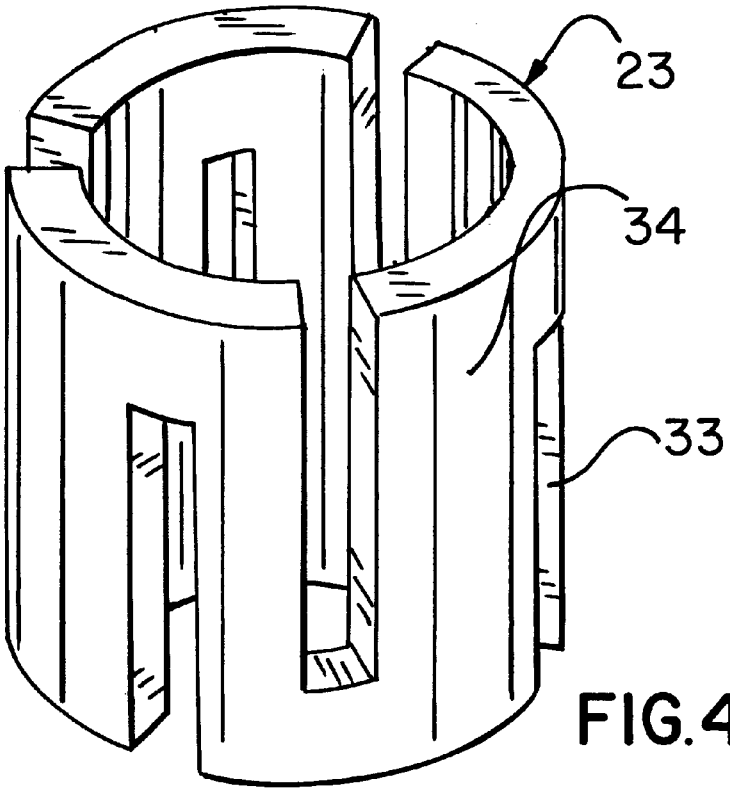
FIG. 4 illustrates another embodiment of the compressible bushing of FIG. 2.

In addition to the configuration described above, bushing 23 can take on many configurations, any of which will satisfactorily serve its intended purpose of bearing against the hopper tube 29 and thereby form a secure fit between the hopper and the gun and yet provide a fit that is easily taken apart. FIG. 4 depicts another configuration of the bushing 23. In this embodiment, there is provided a plurality of openings 33 that extend through the wall and along the axial length of the bushing. However, the openings initiate from alternate ends of the bushing and stop prior to reaching the other end of the bushing. Rather than decrease the overall diameter of the bushing as in the embodiment of FIG. 3, tightening of the nut 20 serves to cantilever the portions 34 of the bushing between the openings 33, at the upper and lower ends of the bushing, inward toward the hopper tube 29. The inward motion being caused by the action of the mating tapered edges of the bushing and the nut, and the bushing and the upper edge of the tube member 14. Other configurations of the openings vis-a-vis the bushing can be readily be envisioned by a person having ordinary skill in the field, which other configurations are intended to be included within the scope of the present invention. Then too, the bushing can be made from a soft rubber or plastic material such that the inward compression caused by the tightening of the nut 20 is accomplished by the inherent compressibility of the material from which the bushing is made. With a soft rubber or plastic bushing, therefore, no openings may be required.

Modifications to the tapered ends of the bushing 23, the edge of the tube member 14, and the flange 22 of nut 20 to cause inward movement of the bushing 23 can also be readily be envisioned by a person having ordinary skill in the field, which other modifications are intended to be included within the scope of the present invention. For example, the tapered edges on the bushing can be located on the outer circumference of the bushing. Further, the taper on the flange 22 of nut 20 can be eliminated, and/or the taper on the upper end of bushing 23 can be eliminated. Thus, only the taper on the bottom of the bushing 23 and the taper on the top of the tube member 14 serve to radially compress bushing 23. While such a configuration will work as intended, it may not be as efficient as the embodiment of FIG. 2. Of course, the angle of the taper and the location of the same are a matter of choice of design.

Figure 5:
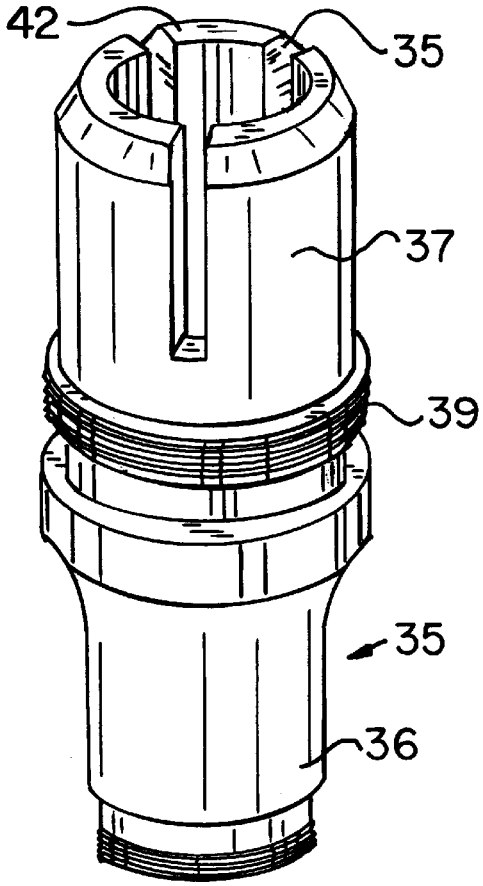
FIG. 5 illustrates a one piece bushing and adaptor tube according to the present invention; and, FIG. 6 illustrates yet another embodiment of the present invention that eliminates the use of a separate adaptor tube.

FIG. 5 illustrates an embodiment of the present invention where the tube member and the bushing are combined in one piece, which will be referred to as the compressible tube member 5 The compressible tube member includes a tube portion 36 and a bushing portion 37 The bushing portion 37 includes one or more openings 38 that extend from the upper edge to a location slightly above the threads 39. Threads 39 serve the same function as in the previous embodiments, i.e. provide for the attachment of the nut 20 which when tightened, forces the upper portion of bushing portion inward and tight against the outer circumference of hopper tube 14. The one-piece compressible tube member 35 will compress in a cantilever fashion, which will work satisfactorily, but will not work as efficiently as the embodiment of FIG. 2.

Figure 6:
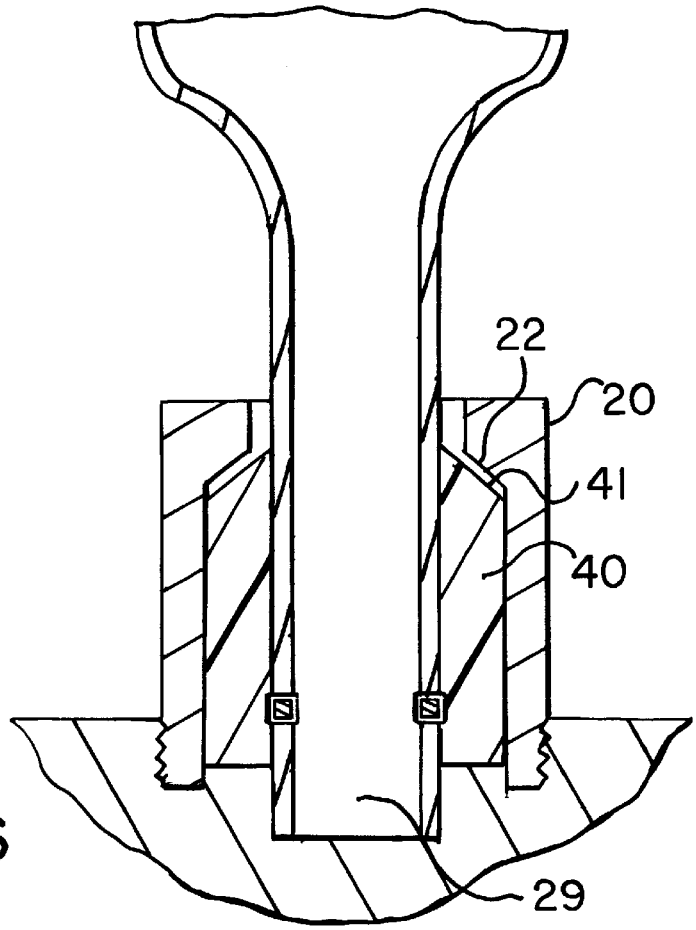

Another embodiment of the present invention is illustrated in FIG. 6. In this embodiment, the invention comprises the nut 20 and a compression member 40 that comprises the bushing portion 37 of the single piece compression tube member of FIG. 5. As the nut 20 is tightened, the tapered flange 22 bears against the tapered edge 41 of bushing 40 causing the portions 42 of the bushing 40 between the slots 38 to cantilever inwardly and against the outer circumference of the hopper tube 29. In operation, the nut 20 is fitted onto the hopper tube 29, the bushing 40 is then fitted onto the hopper tube 29 and is moved axially until the protruding lip of a snap ring 43 snaps into an annular groove provided in the bushing 40. The hopper tube is then inserted into the opening 17 in gun 11. Nut 20 is moved downward, sliding over bushing 40 and is threaded into the correspondingly threaded opening 17 in gun 11. The interaction of the tapered ends of bushing 40 and nut 20 cause the bushing to bear tightly against the hopper tube 29, completing the connection.

It is to be understood that turning any member end for end, or providing a compressible connection where the tube member attaches to the gun do not fall outside the scope of the present invention comprising attaching a hopper to a paint ball gun using an adaptor in combination with a compressible member. For example, Where the gun includes a tubular member extending out of the gun, another compression fitting located at the bottom of the adaptor tube can be used. In this embodiment, another bushing is fitted within another nut, both of which are positioned in a direction opposite to the bushing and nut at the top of the adaptor tube.

In order that the connection between the hopper 12 and the gun 11 can be made and disengaged in the field, and without tools, the outside surfaces of the cylindrical member 14 and the nut 20 can be knurled to permit hand tightening and loosening.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved.

We claim:

1. Apparatus for attaching a paint ball hopper to a paint ball gun comprising a radially compressible bushing having a first end surface and a second end surface, a nut configured to contact said first surface of the bushing, a tube member axially aligned with the bushing and configured to contact said second surface of the bushing, said tube member including screw threads, said nut being threadingly connected to said tube member, whereby tightening the nut onto the tube member causes the bushing to compress in a radial direction, wherein said first surface of said bushing comprises an end edge of said bushing, and said second surface of said bushing comprises a second and opposite end edge of said bushing wherein both of said bushing edges are tapered and said contact of said nut and said tube member with said bushing includes tapered surfaces on said nut and said tube member wherein said bushing includes an opening through a wall thereof, said opening extending from one end edge to the other end edge of said bushing.

2. The apparatus of claim 1 wherein said nut fits over said bushing and said bushing is non-permanently attached to said nut.

3. Apparatus for attaching a paint ball hopper to a paint ball gun comprising a radially compressible bushing having a first end surface and a second end surface, a nut configured to contact said first surface of the bushing, a tube member axially aligned with the bushing and configured to contact said second surface of the bushing, said tube member including screw threads, said nut being threadingly connected to said tube member, whereby tightening the nut onto the tube member causes the bushing to compress in a radial direction, wherein said bushing comprises a cylindrical member, open across both ends, and an opening extending from one end edge to the other end edge.

4. Apparatus for attaching a paint ball hopper to a paint ball gun comprising a radially compressible bushing having a first end surface and a second end surface, a nut configured to contact said first surface of the bushing, a tube member axially aligned with the bushing and configured to contact said second surface of the bushing, said tube member including screw threads, said nut being threadingly connected to said tube member, whereby tightening the nut onto the tube member causes the bushing to compress in a radial direction, wherein said bushing comprises a cylindrical member, open across both ends, and at least two openings through a wall of said bushing, with a one of said at least two openings extending from a first end edge of said bushing to a position near the second end of said bushing, a second of said at least two openings extending from said second end edge of said bushing to a position near the first end of said bushing.

5. Apparatus for attaching a paint ball hopper to a paint ball gun comprising a radially compressible bushing having a first end surface and a second end surface, a nut configured to contact said first surface of the bushing, a tube member axially aligned with the bushing and configured to contact said second surface of the bushing, said tube member including screw threads, said nut being threadingly connected to said tube member, whereby tightening the nut onto the tube member causes the bushing to compress in a radial direction, wherein said bushing comprises a cylindrical member, open across both ends, and at least one opening through a wall of said bushing extending from a first end edge of said bushing to a position near the second end of said bushing.

* * * * *